US005115651A

United States Patent [19]

Nukaga et al.

[11] Patent Number: 5,115,651

[45] Date of Patent: May 26, 1992

[54] DRUM-TYPE WASHING MACHINE

[75] Inventors: Tadashi Nukaga; Kentaro Mochizuki; Shinji Yamaguchi; Yoshikazu Banba, all of Shiga, Japan

[73] Assignee: Sanyo Electric Co., Ltd., Osaka, Japan

[21] Appl. No.: 592,702

[22] Filed: Oct. 3, 1990

[30] Foreign Application Priority Data

Oct. 5, 1989 [JP] Japan ..... 1-260761
Oct. 24, 1989 [JP] Japan ..... 1-277805

[51] Int. Cl.[5] ..... D06F 25/00; D06F 37/22; D06F 39/02; D06F 39/08

[52] U.S. Cl. ..... 68/17 R; 68/19.2; 68/20; 68/23.2; 68/24; 68/23.5; 68/208; 210/363

[58] Field of Search ..... 68/17 R, 19.2, 20, 23.2, 68/24, 23.5, 208; 210/144, 363, 364, 365; 74/573 F

[56] References Cited

U.S. PATENT DOCUMENTS 2,539,533 1/1951 Douglas ..... 68/23.2 X
2,647,386 8/1953 Keiper ..... 68/23.2
2,895,320 7/1959 Long ..... 68/23.5 X
2,984,094 5/1961 Belaieff ..... 68/23.2
3,220,229 11/1965 Livesay ..... 68/19.2
3,740,975 6/1973 Cornelius ..... 68/24 X
4,551,996 11/1985 Hirose et al. ..... 68/20
4,862,712 9/1989 Hottemann ..... 68/17 R

FOREIGN PATENT DOCUMENTS 55-2998 1/1980 Japan .
60-45559 10/1985 Japan .

*Primary Examiner*—Philip R. Coe
*Attorney, Agent, or Firm*—Darby & Darby

[57] ABSTRACT

A drum-type washing machine includes a resin drum which is rotatably supported in a frame by a horizontal shaft. The resin drum includes a body portion molded out of a synthetic resin, and an end surface formed at one end of the body portion, the other end being open. A fluid balancer positioned at the open end of the body portion includes a hollow annular member and a predetermined amount of saltwater sealed therein. The drum diameter is increased from the one end to the other end by utilizing a taper or slope from a plastic molding process. Therefore, the wash in the drum, in operation, moves to the vicinity of the fluid balancer at the other end of the drum along the slope of the inner surface of the drum, thereby to produce a maximum balancing effect of the fluid balancer.

18 Claims, 19 Drawing Sheets

DRUM-TYPE WASHING MACHINE

BACKGROUND OF THE INVENTION

1. Field of the Invention

The present invention relates to a drum-type washing machine. More specifically, the present invention relates to a drum-type washing machine having a horizontal shaft-type drum which is rotatably supported within an outer tub in a frame.

2. Description of the Prior Art

One example of a conventional drum-type washing machine is disclosed in, for example, Japanese Patent Publication No. 55-2998. In this prior art, an outer tub is supported in a frame and a washing drum of a horizontal shaft-type is rotatably supported in the outer tub, and by rotating the washing drum, the wash entered in the drum is washed, dehydrated and dried. In addition, annular balancers are respectively provided at both edges of the drum.

Furthermore, a drum-type washing machine in which a diameter of a drum on a side of its one end surface is made larger than that on a side of its other end surface is disclosed in Japanese Patent Publication No. 60-45559.

The former prior art has a disadvantage that a manufacturing cost is high because there are provided with two balancers. In addition, if one of the balancers is omitted, a stable balancing effect cannot be obtained because a balancing performance differs depending on whether the wash in the drum is in a position closed to or far from the balancer.

Furthermore, the latter prior art fails to show a balancer and, even if the latter prior art is provided with a balancer as in the former prior art, as similar to the former prior art there is a disadvantage that a stable balancing effect cannot be obtained depending on a positional relation between the balancer and the wash.

SUMMARY OF THE INVENTION

Therefore, a principal object of the present invention is to provide a novel drum-type washing machine.

Another object of the present invention is to provide a drum-type washing machine in which a good balancing effect can be obtained when a drum is rotated.

Another object of the present invention is to provide a drum-type washing machine which is made relatively lightweight.

Another object of the present invention is to provide a drum-type washing machine wherein the strength of a drum is improved even if the drum is formed of a synthetic resin.

Another object of the present invention is to provide a drum-type washing machine wherein it is possible to prevent the wash from being "jumped out" at the time of opening a cover for a clothes entering port of the drum and prevent the wash from being damaged.

Another object of the present invention is to provide a drum-type washing machine capable of improving a detergency.

Another object of the present invention is to provide a drum-type washing machine in which the wash can be dried rapidly.

Another object of the present invention is to provide a drum-type washing machine capable of preventing water from being excessively overflowed.

Another object of the present invention is to provide a drum-type washing machine capable of speeding a discharge of bubbles.

Another object of the present invention is to provide a drum-type washing machine in which a cooling chamber for dehumidification need not be separately provided.

A drum-type washing machine in accordance with the present invention comprises: a frame; an outer tub supported in the frame; a drum of a horizontal shaft-type which is rotatably supported in the outer tub, said drum having a lot of throughholes on its peripheral surface and the diameter of said drum being increased from one end surface to its other end surface; and a balancer provided on the other end surface of the drum for smoothing rotation of the drum.

In addition, if the body portion of the drum is molded out of a synthetic resin, by forming a draft or slope (as used on a mold for molding) on the peripheral surface of the body portion so that the diameter thereof is increased from the one end surface to the other end surface, it is possible to make the diameter at the one end surface larger than the diameter the other end surface. When the drum is thus molded out of a synthetic resin, the weight of the drum becomes light, and therefore, it is possible to make a drum-type washing machine lightweight as a whole.

In the present invention, since the wash in the drum is naturally moved to the vicinity of the balancer due to the slope of the inner peripheral surface of the drum, a maximum balance effect of the balancer can be exhibited.

In a case where the balancer is a fluid balancer in which a fluid is sealed inside of a hollow annular member, a weight of the balancer itself is light, and therefore, it is possible to make a drum-type washing machine lightweight as a whole.

When a concave and convex surface is formed on an inner peripheral surface of the drum, a strength thereof can be increased and the drum is not easily deformed, and the wash is scrubbed by the concave and convex surface to increase a detergency.

When a cover for opening and closing a clothes entering port formed on a peripheral surface of the drum is provided and a concave and convex surface is also formed on an inner surface of the cover, a detergency can be improved because the wash is scrubbed by the concave and convex surface, too. In addition, by forming the concave and convex surface on the inner surface of the cover, the wash does not easily adhere to the inner surface of the cover, and therefore, the wash is not jumped out and damaged at a time of opening the cover.

If a balancer is provided so that an inner peripheral surface of the balancer is positioned inside the drum and a concave portion is formed on the inner peripheral surface of the balancer, a detergency is further improved because the wash in the drum is scrubbed by the concave portion of the balancer, and it is possible to prevent a fluid from being one-sided because the concave portion functions as a resistance member for limiting a movement of the fluid in the balancer.

In addition, if an introducing portion for introducing a drying air is provided on the side of the other end surface of the drum and an inclined surface is formed on an inner peripheral surface of the balancer so that an inner diameter of the balancer is increased from an outer portion to an inner portion, the drying air introduced from the side of the other end surface of the drum is guided by a horn shape of the inner peripheral surface of the balancer to be spread in an entire drum.

Furthermore, since the inner peripheral surface of the drum is so sloped as to shrink as it is farther apart from the introducing portion, the drying air introduced from the introducing portion is guided by such a slope to converge in a central portion of the drum, that is, is liable to be trapped in the drum, thereby to enhance a temperature raising effect in the drum.

In addition, if the introducing portion for the drying air is provided at the side of the other end surface of the drum, the inner peripheral surface of the drum is sloped so that a diameter thereof is increased as it is farther apart from the introducing portion, and therefore, the drying air introduced from the introducing portion easily spreads from one corner portion of the drum to the other corner portion thereof in conformity with such a slope, thereby to improve an efficiency in a drying step or process.

If an overflowed water port which is formed on the outer tub is positioned at a portion opposite to the other end surface of the drum, the drum is sloped downward toward the overflowed water port, and therefore, when the drum is rotated in a washing step or process, the water level on the opposite side of the overflowed water port becomes in the outer tub due to such a slope, to made it difficult for a washing water to be overflowed from the overflowed water port, and therefore, it is possible to prevent the detergency from being lowered.

If a overflowed water port formed on the outer tub is positioned at a portion opposite to the one end of the drum, the drum is sloped downward toward the opposite side of the overflowed water port, and therefore, when the drum is rotated in a washing step or process, the water level on the side of the overflowed water port becomes high in the out tub due to such a slope, to make it easy for bubbles to be discharged from the overflowed water port.

In another embodiment of the present invention, since a water is caused to flow along an inner surface of a wall of an outer tub, a drying air is cooled and dehumidified by the water. Therefore, a specific cooling chamber need not be provided for cooling the drying air in a drying step or process to dehumidify the same.

If a drainage port is intermittently opened and closed in a drying step or process, waste thread accumulated in a bottom portion of the outer tub in a washing step or process can be discharged along with a dehumidification water. More specifically, the dehumidification water is temporarily accumulated in the bottom portion of the outer tub while the drainage port is closed, and the same is drained off when the drainage port is opened, and therefore, the waste thread is discharged along with the dehumidification water.

Furthermore, when an outer tub is also molded out of a synthetic resin, as similar to the drum, if a diameter of the outer tub is increased from a side of one end to a side of the other end of the outer tub, a gap between the drum and the outer tub become minimum, and therefore, it is not necessary to large a capacity of the outer tub so much even if a capacity of the drum is made large. Therefore, it is possible to obtain a drum-type washing machine having a large capacity but being compact.

In addition, if a concave portion is formed on a cover for opening and closing a clothes entering port so as to store therein washing processing agents such a softening agent, the washing processing agents can be entered between the outer tub and the drum while the drum is rotated.

The objects and other objects, features, aspects and advantages of the present invention will become more apparent from the following detailed description of the embodiments of the present invention when taken in conjunction with accompanying drawings.

DETAILED DESCRIPTION OF THE PREFERRED EMBODIMENTS

Figure 1:
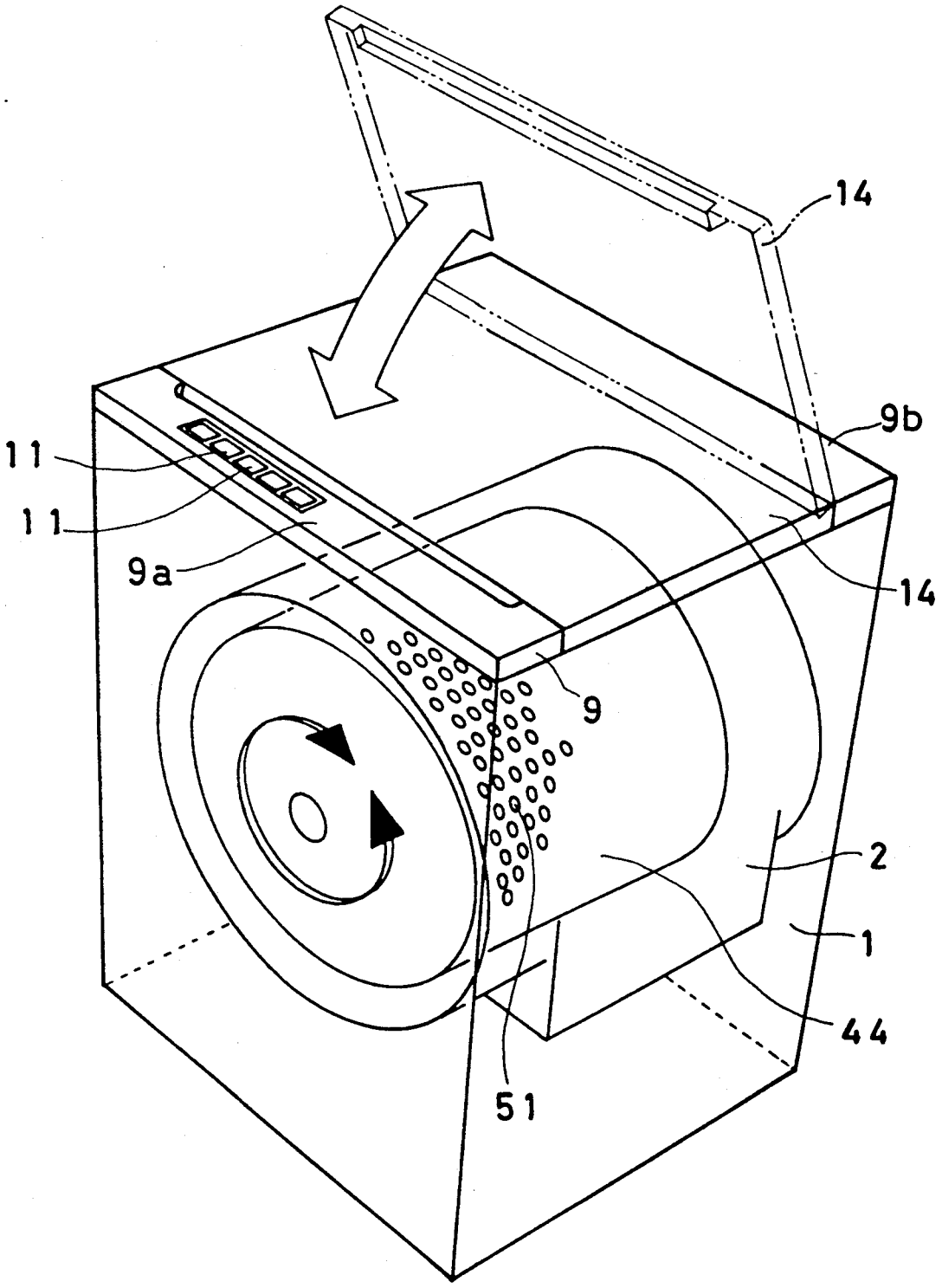
FIG. 1 is an illustrative view showing a whole appearance of one embodiment in accordance with the present invention.

In FIGS. 1 to 4, a reference numeral 1 denotes a frame made of sheet metal, a reference numeral 2 denotes an outer tub molded out of a synthetic resin in approximately the same shape as that of a horizontal shaft drum, a reference numeral 3 denotes a horizontal supporting surface formed on a lower surface of the outer tub 2, and a reference numeral 4 denotes a mounting plate made of iron which is fixed to the horizontal supporting surface 3.

Reference numerals 5, 5, . . . denote upper supporting members for elastically suspending and supporting the outer tub 2 from four corners in an upper portion of the frame 1, reference numerals 6, 6, . . . denote a lower supporting members provided between the mounting plate 4 of the outer tub 2 and four corners in a bottom portion 1*a* of the frame 1, and a reference numeral 7 denotes a duct or passageway integrally formed by projecting an upper portion of the outer tub 2 upward in a shape of a square tube, thereby to form a first clothes entering port 8 on an upper portion of the outer tub 2. A reference numeral 9 denotes an upper plate made of a synthetic resin which is fixed to an upper end of the frame 1, an operation portion 9*a* for containing electronic components and a containing portion 9*b* for containing a feed water device and etc. being respectively provided with they being expanded at its front edge and its rear edge. A second clothes entering port 10 of a rectangular shape is formed in a center portion of the upper plate 9. Reference numerals 11, 11, . . . denote various operation keys provided on an upper surface of the operation portion 9*a* as shown in FIG. 1.

A reference numeral 12 denotes a rubber packing in a bellows shape by which the second clothes entering port 10 and the first clothes entering port 8 are watertightly connected to each other. A reference numeral 13 denotes a safety cover for opening and closing the second clothes entering port 10, a reference numeral 14 denotes an upper cover for opening and closing an upper surface of the safety cover 13, and a reference numeral 15 denotes a torsion coil spring attached to a base portion of the upper cover 14 so as to give the opening and closing of the upper cover 14 a click feeling.

Figure 6:
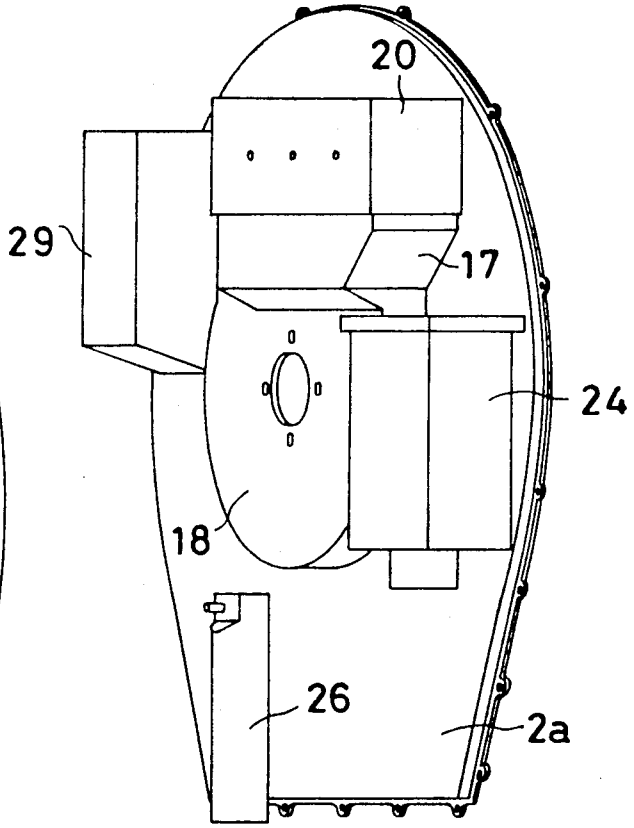
FIG. 6 is a perspective view showing a rear wall of an outer tub.
Figure 5:
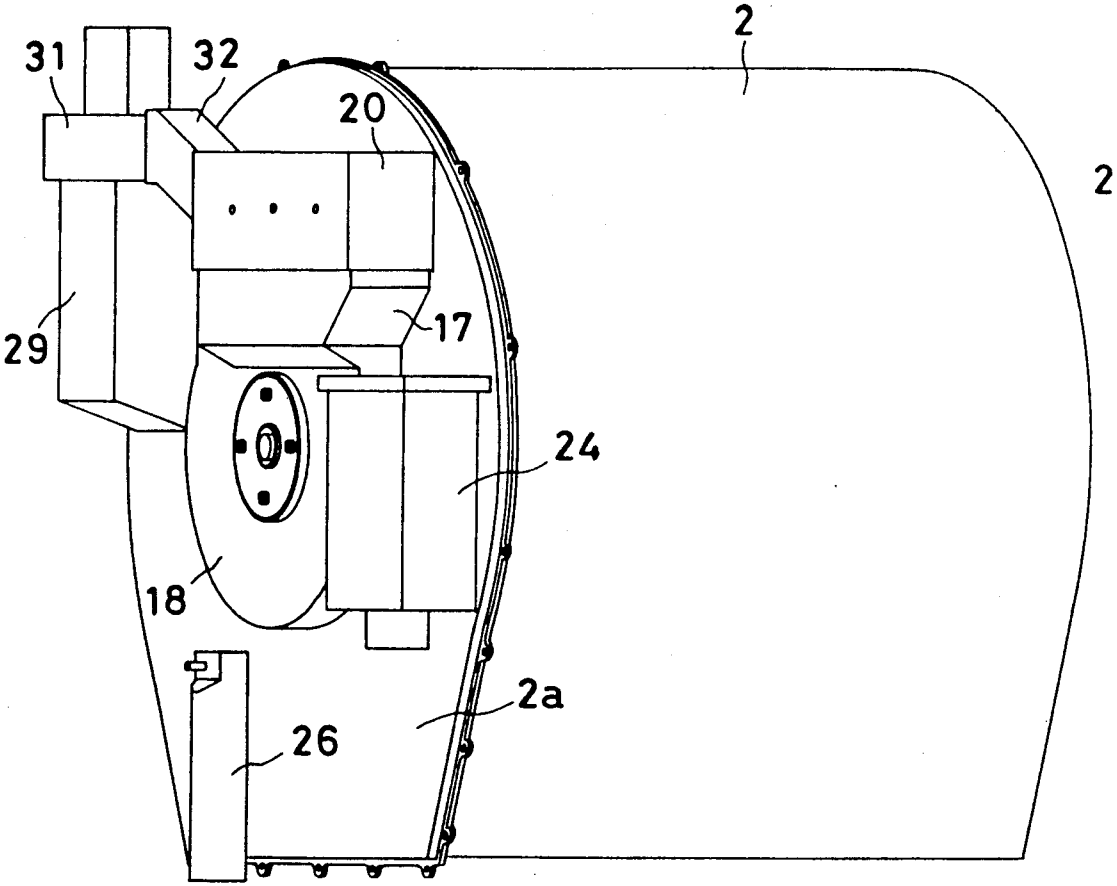
FIG. 5 is a perspective view showing an outer tub of FIG. 1 embodiment.

In FIGS. 5 and 6, only a rear wall 2*a* of the outer tub 2 is formed separately from the other portions thereof. The rear wall 2*a* is fastened to the outer tub 2 after a drum 44 (described later) is contained in the outer tub 2 from a rear opening of the outer tub 2. A reference numeral 16 denotes a cylinder portion integrally formed with it being projected inward in a central portion of the rear wall 2*a*, and a reference numeral 17 denotes an air duct integrally formed on an outer surface of the rear wall 2*a*, which is formed to be extended from a center of an upper portion of the rear wall to the cylinder portion 16. A wall surface 18 covering the cylinder portion 16 is in close proximity to the cylinder portion 16, to which a drum rear bearing 19 is fixed. In addition, a heater casing 20 is formed in an upper portion of the air duct 17, in which a drying heater 21 is housed. A reference numeral 22 denotes an iron plate surrounding the heater 21, which is used for preventing dust or the like, which is ignited, from spreading to a resin material.

A reference numeral 23 denotes an overflowed water port provided in a position at a height which is one-half that of the rear wall 2*a*, a reference numeral 24 denotes an overflowed water chamber integrally formed in the rear wall 2*a* for introducing a water overflowed from the overflowed water port 23, reference numerals 25 denote a pair of electrodes provided in the overflowed water chamber 24 for detecting abnormal foaming, and a reference numeral 26 denotes an air trap integrally formed in a lower portion of the rear wall 2*a*, which is connected to a water level sensor 27 provided in the containing portion 9*b* through a pressure hose 28. A reference numeral 29 denotes a circulating air path integrally formed in a position above a level of overflowed water of the rear wall 2*a*, which communicates with the outer tub 2 through a circulating port 30. A reference numeral 31 denotes a blast fan provide in the circulating air path 29. The circulating air path 29 is provided with an intake port (not shown) of the blast fan 31. A reference numeral 32 denotes a connecting pipe for connecting the circulating air path 29 to the drying air duct 17.

A reference numeral 33 denotes a drainage port provided in a bottom portion of the outer tub 2, and a reference numeral 34 denotes a drain hose for introducing a water drained-off from the drainage port 33 into an exterior of a washing machine. The bottom portion of the overflowed water chamber 24 is connected to this drain hose 34 through an overflowed water hose 35. A reference numeral 36 denotes an electric drain valve for opening and closing the drainage port 33, which winds a wire up by a turning force of a drainage motor 34 to open the valve, while breaking the turning force of the motor to return the valve to its closed state by urging a spring (not shown), as well known.

A reference numeral 38 denotes a two-port electromagnetic feed water valve device provided inside the containing portion 9*b*. One feed water valve 38*a* is connected to a connecting port portion 40 formed in the muff 7 through a first feed water hose 39 and the other feed water valve 38*b* is connected to an upper portion of the outer tub 2 through a second feed water hose 41. More specifically, a water fed and discharged from the second feed water hose 41 is dropped along an inner peripheral surface of the outer tub 2 to lead to the drainage port 33.

A reference numeral 42 denotes a sheath heater provided in an inner bottom portion of the outer tub 2, and a reference numeral 43 denotes a drum rear bearing fixed to a central portion of a front wall 2*b* of the outer tub 2.

Figure 7:
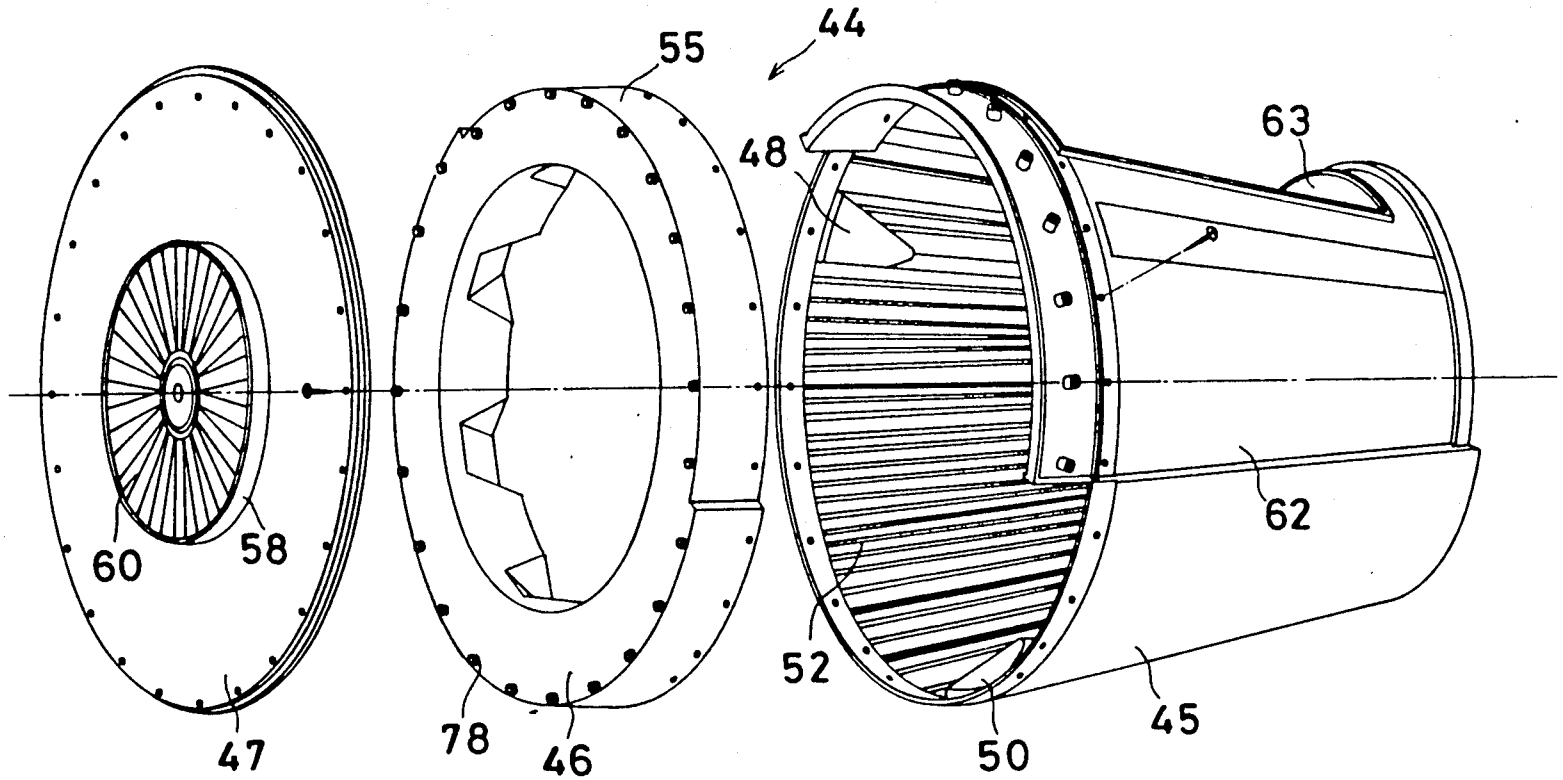
FIG. 7 is an exploded perspective view showing a drum of FIG. 1 embodiment.
Figure 8:
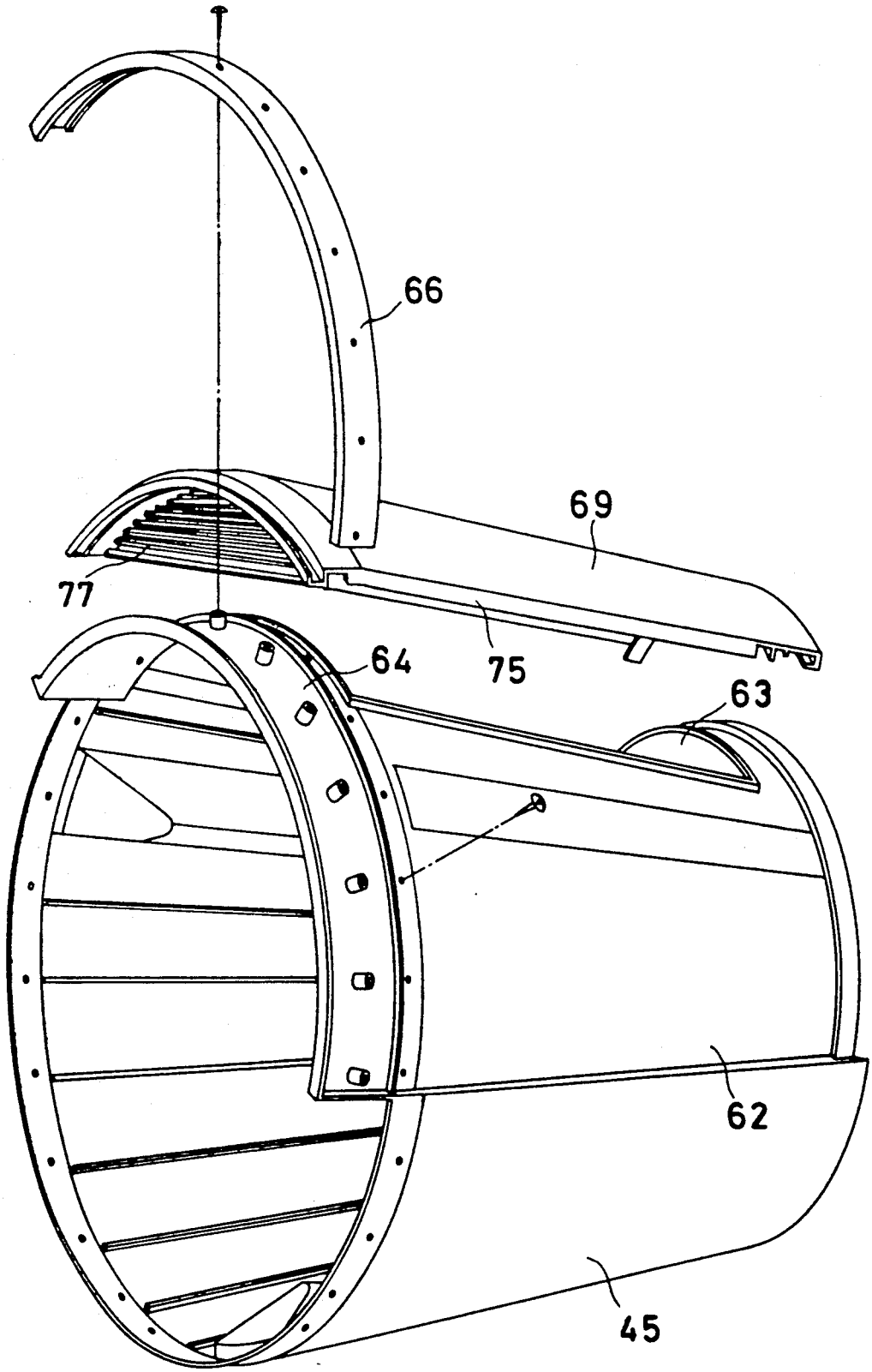
FIG. 8 is an exploded perspective view showing a body portion of a drum.

A reference numeral 44 denotes a horizontal shaft-type washing and dehydrating and drying drum made of a synthetic resin, which is rotatably supported in the outer tub 2. As shown in FIG. 7, the drum comprises a body portion 45 which is opened on a side of its rear surface, a fluid balancer 46 mounted on the body portion 45 at the side of its rear surface, a rear plate 47 fixed to the fluid balancer 46 on a side of its rear surface. In addition, the body portion 45 is formed with a rapping slope of 1.5° at a time of molding thereof, whose diameter is gradually increased from its front surface to its rear surface.

Reference numerals 48, 49 and 50 denote baffles triangular in cross-section, which are formed as inward, generally radial protrusions at each 120° position along an inner peripheral surface of the body portion 45, reference numerals 51 denote a lot of throughholes formed around the body portion 45, and reference numerals 52 denote a lot of transverse ribs integrally formed upright along the inner peripheral surface of the body portion 45. The first transverse ribs 52 are also formed on upper surfaces of the baffles 48–50.

The balancer 46 is formed by sealing a predetermined amount of salt water in a hollow annular member. Inside of the balancer 46, resistance plates 53 are provided upright for each 30° inward from a side of its rear surface. Spacing between the resistance plates 53 and an inner peripheral surface of the balancer 46 is set to 5 mm or less and such that the spacing on a side of its outer periphery is smaller than that on a side of its inner periphery. Reference numerals 54 denote concave portions formed along the inner peripheral surface of the balancer 46. The concave portions 54 also function as resistance plates, to circulation of salt water in the balancer 46. A reference numeral 55 denotes a concave portion formed on a peripheral surface of the balancer 46 by reducing a diameter of a circular arc portion having a central angle of approximately 150° in the balancer 46.

An inlet port 58 inserted into the cylinder portion 16 is formed with its being projected in a central portion of the rear plate 47. A supporting shaft 59 is fixed to a central portion of the inlet portion 58. In addition, a fan 60 also serving as a filter for droplets is integrally formed in the inlet port 58. A reference numeral 61 denotes a supporting shaft fixed to a central portion of a front plate 45*a* of the body portion 45. More specifically, in the drying step or process, a drying air circulates in the order of the blast fan 31, the connecting pipe 32, the heater 21, the drying air duct 17, the inlet port 58, the drum 44, throughholes 51, the circulating port 30, the circulating air path 29, and the blast fan 31. Furthermore, at a time of this drying step, the second feed water valve 38*b* is driven to feed a water along the inner peripheral surface of the outer tub 2 and the drying air is cooled and dehumidified by this water as fed.

A reference numeral 62 denotes a concave portion formed by reducing a diameter of a circular arc portion having a central angle of approximately 150° in the body portion 45, a reference numeral 63 denotes a third clothes entering port in a rectangular shape, which is provided in a bottom portion of the concave portion 62, and reference numerals 64 and 65 denote slide grooves formed at front and rear edges of a bottom portion of the concave portion 62, one of the slide grooves 64 being formed by attaching a slide cover 66 formed separately from the other portions of the slide grooves 64.

A reference numeral 67 denotes a claw to be engaged which is formed with its being projected upward at one side edge of the third clothes entering port 63, and a reference numeral 68 denotes an abutting rib which is formed with its being projected upward at the other side edge of the third clothes entering port 63.

A reference numeral 69 denotes a cover made of a synthetic resin for opening and closing the third clothes entering port 63, which is supported in the slide grooves 64 and 65 so as to slide in the concave portion 62. More specifically, the cover 69 is contained in the concave portion 62, and a surface of the cover 69 and the peripheral surface of the drum 64 are approximately coplanar. Accordingly, the peripheral surface of the drum 44 becomes approximately circular. Consequently, a balancing effect of the drum 44 is good, and a degree of mixing a detergent by the cover 69 is low, not to advance foaming.

A reference numeral 70 denotes a concave portion integrally formed along one side edge of the cover 69, which has a length that is at least one-half that of the side edge. A reference numeral 71 denotes a handle portion rotatably supported in the concave portion 70, an engaging claw 72 engaged with the claw 67 to be engaged being formed on the side of its one end and a handle concave portion 73 being formed on a side of its other end. The handle portion 71 is always urged by a spring 74 in a direction where the engaging claw 72 is engaged with the claw 67. A reference numeral 75 denotes a regulating rib formed with its being projected downward at the other side edge of the cover 69, and a reference numeral 76 denotes a storage portion integrally provided in a concave shape in a central portion of an upper surface of the cover 69, which stores washing processing agents such as a detergent, a breaching agent and a softening agent. Reference numerals 77 denote second transverse ribs integrally formed on a whole inner surface of the cover 69, which are so constructed that shapes and directions of projection thereof are the same as those of first transverse ribs 52.

The balancer 46 is fitted in the body portion 45 and is screwed into a rear end of the body portion 45 when the same abuts on an end surface of the baffles 48, 49 and 50 and then, is screwed into screw bosses 78 with the rear plate 47 applied to a rear surface of the balancer 46, thereby to complete the drum 46. On this occasion, the concave portion 55 of the balancer 46 is fitted in the concave portion 62 of the body portion 45, and therefore, the balancer 46 is positioned and stopped to be rotated.

Furthermore, the drum 44 is rotatably supported on the drum rear bearing 19 and the drum front bearing 43 by supporting shafts 59 and 61. In addition, the supporting shaft 61 is projected from the front wall 2*b* of the outer tub 2, to which a driving pulley 79 is fixed.

A reference numeral 80 denotes a washing motor fixed to the mounting plate 4 through a fitting 81, and a reference numeral 82 denotes a dehydrating motor fixed to the mounting plate 4 though a fitting 83. A brake drum 84 is fixed to a motor shaft of the dehydrating motor 82. The washing motor 80 and the dehydrating motor 82, and the dehydrating motor 82 and the driving pulley 79 are respectively connected to each other through pulleys and belts. A reference numeral 85 denotes a brake lever whose base end is rotatably supported on the fitting 83, which has a brake shoe 86. At a time of opening the upper cover 14, the brake shoe 86 is in contact with the brake drum 84 by urging a spring (not shown). A reference numeral 87 denotes a wire having its one end connected to the brake lever 85 and its other end connected to the torsion coil spring 15, and a reference numeral 88 denotes a guiding and protecting tube of the wire 87.

When the upper cover 14 is closed, a connecting portion 15*a* of the torsion coil spring 15 is dispressed upward to pull the wire 87, to rotate the brake lever 85 so that the brake shoe 86 is separated from the brake drum 84. On the other hand, when the upper cover 14 is opened, the connecting portion 15*a* of the torsion coil spring 15 is displaced downward to loosen the wire 87 and therefore, the brake shoe 86 comes into contact with the brake drum 84, to exert a braking force on the dehydrating motor 82.

In order to open the cover 69, the handle concave portion 73 is pushed-down to release a state where the engaging claw 72 and the claw 67 to be engaged are engaged with each other, to directly slide the cover 69 in a direction of opening. On the other hand, in order to close the cover 69, the engaging claw 72 is pushed-up along an inclined surface of the claw 67 to be engaged by sliding the cover 69 in a direction of closing, to be automatically engaged with the claw 67.

In a drum-type washing machine having such a construction, in a washing step or process, the drum 44 is repeatedly reversed at a low speed by the washing motor 80, so that the wash in the drum 44 is lifted by the baffles 48–50 and is dropped downward from the above, that is, a so-called tap washing is done and at the same time, a scrub washing is done by the first transverse ribs 52 and the second transverse ribs 77.

In addition, in a dehydration step or process, the drum 44 is rotated in one direction at a high speed by the dehydrating motor 82, so that the wash in the drum 44 is dehydrated by a centrifugal force.

In a drying step or process, as described later, the drum 44 is repeatedly reversed at a low speed by the washing motor 80, and a drying air is introduced into the drum 44 from the drying air duct 17 and the inlet port 58 to exchange heat with the wash in the drum 44.

Although in the present embodiment, individual motors are employed for low-speed rotation in the washing process and the drying process and for high-speed rotation in the dehydration process, the two motors may be replaced with a single so-called inverter motor whose number of rotation is changed by changing a frequency of a driving signal, in which case the washing machine can be made more lightweight.

In addition, although a diameter of the drum 44 is smoothly increased in a tapered shape, the present invention is not particularly limited to the same, and it may be increased in a stepped manner, for example.

In any of the steps or processes, the wash fixed to the inner peripheral wall of the drum 44 is liable to be stripped-off and the wash fixed to the upper portion of the drum 44 is immediately stripped-off to be dropped downward by the first transverse ribs 52 and the second transverse ribs 77 formed inside the drum 44.

Figure 9:
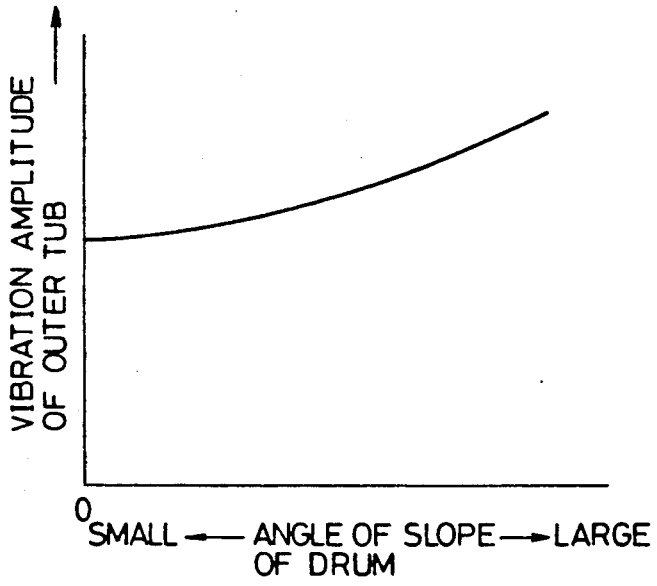
FIG. 9 is a graph showing a vibration characteristic at a time of dehydration step or process in FIG. 1 embodiment.

In addition, since the body portion 45 is sloped downward toward its rear surface, that is, the balancer 46, the wash in the drum 44 is liable to be moved to the vicinity of the balancer 46 in conformity with such a slope, to exhibit a balancing effect of the balancer 46 more effectively. FIG. 9 experimentally verifies the forgoing, which shows that the steeper the slope of the body portion 45 is, the more easily the wash is positioned in the vicinity of the balancer 46, so that a degree of vibration at the time of dehydration is low.

Furthermore, since the drying air is introduced into the drum 44 from the inlet port portion 58, the wash positioned in a corner portion on a side of the rear surface of the drum 44 is not easily exposed to the drying air because the corner portion is a dead angle. Since the body portion 45 is sloped, however, the drying air which strikes once the central portion on the front surface of the drum 44 and rebounds therefrom is induced in the above described corner portion in conformity with the slope, to dry the wash in the corner portion.

Figure 2:
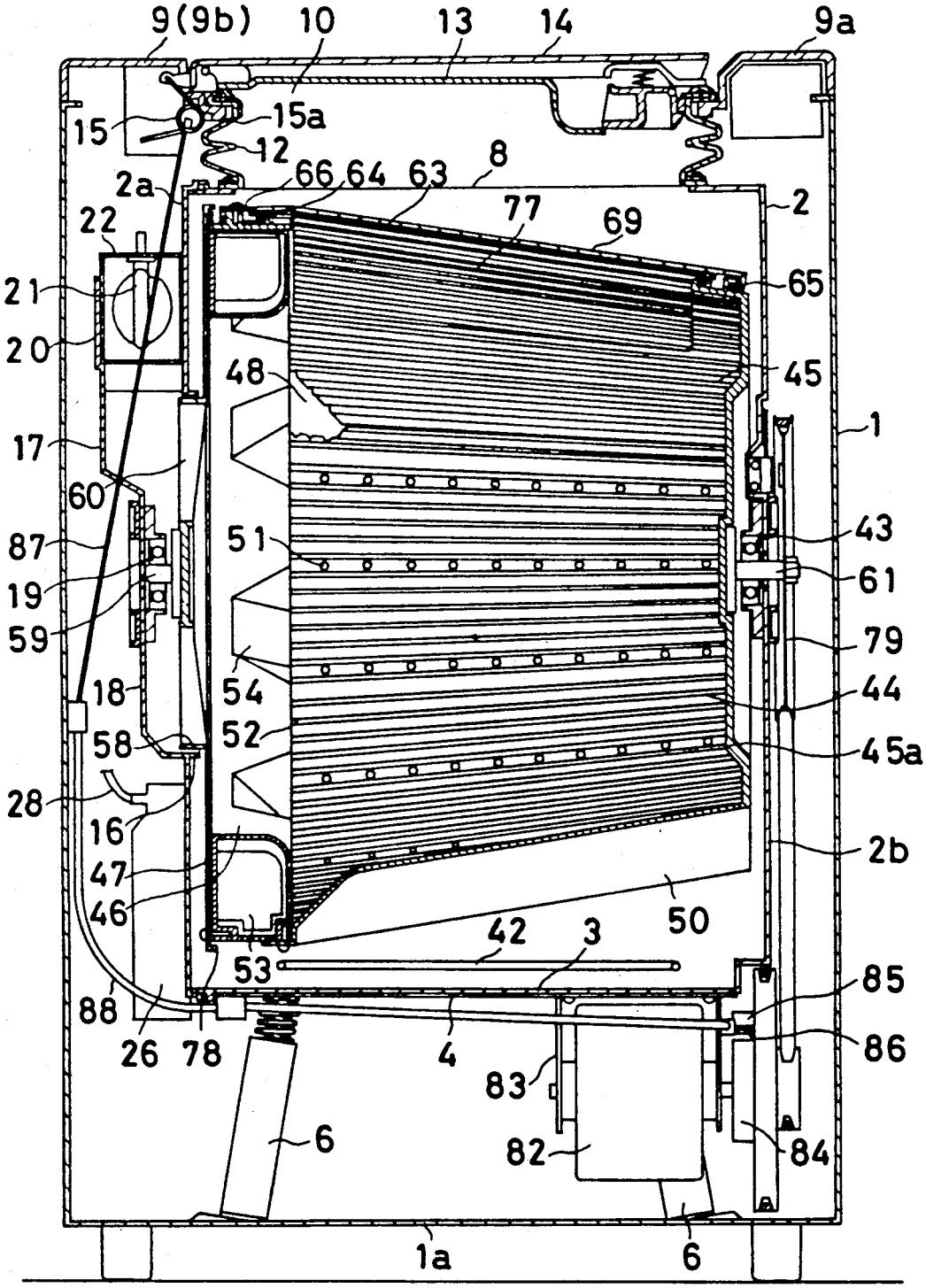
FIGS. 2–4 are cross-sectional views showing an interior structure of FIG. 1 embodiment.
Figure 3:
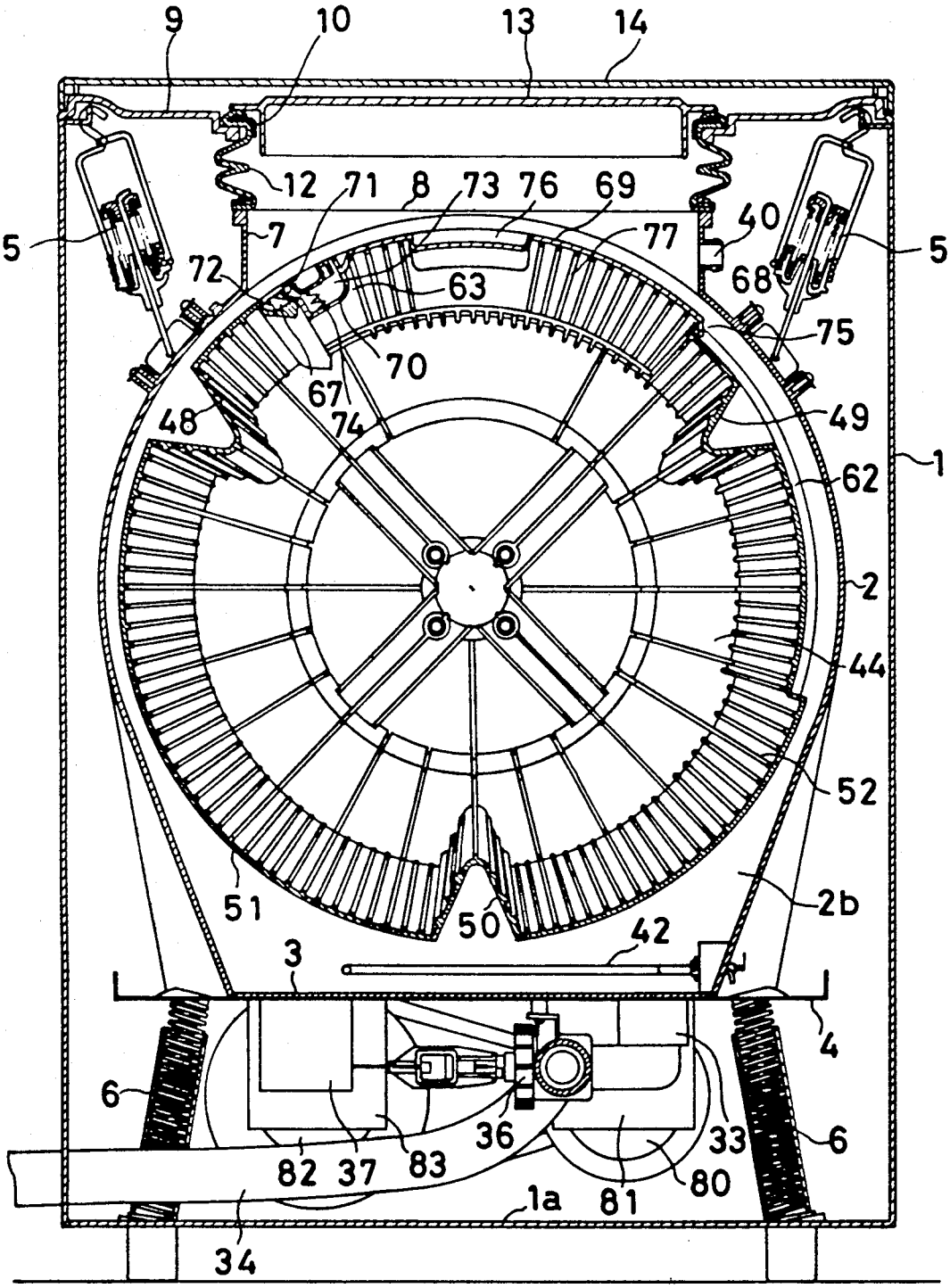
Figure 4:
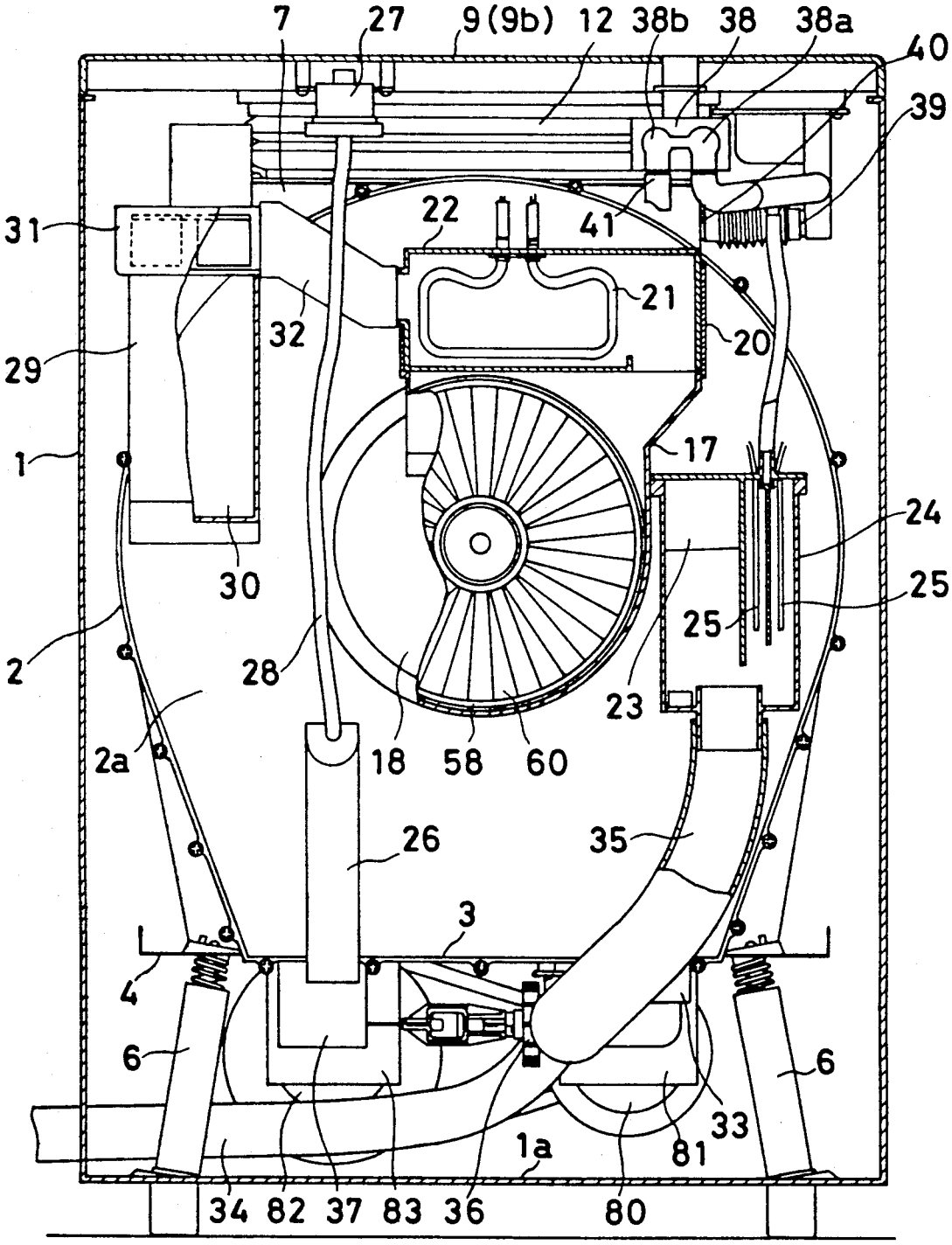

In addition, in FIG. 2, the drying air introduced from the inlet port portion 58 is induced in conformity with the slope of the drum 44 to converge in the central portion of the drum 44, that is, is liable to be trapped in the drum 44. Consequently, the washing machine is high in temperature raising effect within the drum 44 and is superior in a drying performance.

Furthermore, when the drum is rotated at a time of washing, the water level of the washing water on a side of the front surface of the outer tub 2 becomes higher because the drum 44 is downward-inclined backward. Therefore, the washing water is not easily overflowed from the overflowed water port 23, thereby to make it possible to prevent the amount of the washing water from being reduced.

Figure 10:
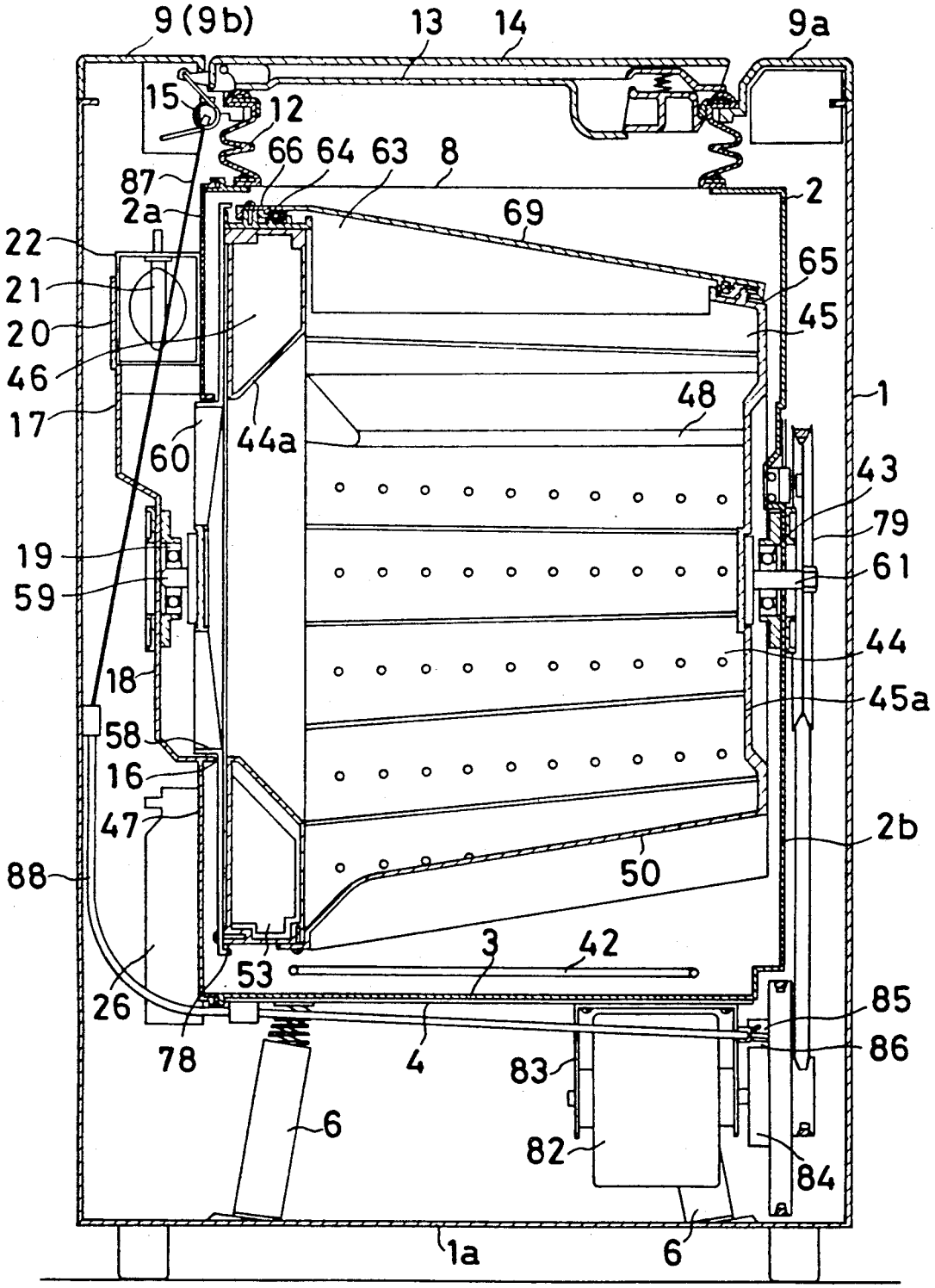
FIGS. 10–12 are illustrative views respectively showing another embodiment in accordance with the present invention, which respectively correspond to FIG. 2.

Then, since the drying air is introduced into the drum 44 from the inlet port portion 58 of the drum 44, an air force in the central portion of the drum 44 is large, while an air force in the vicinity of the inner peripheral surface of the drum 44 is small. Accordingly, a dryness factor of the wash to be dried which are positioned in the vicinity of this inner peripheral surface is low, so that nonuniformity of drying may be caused in the drum 44. In FIG. 10, an inner diameter of the balancer 46 on the side of its outer surface is made approximately equal to a diameter of the inlet port portion 58, and the inner peripheral **46*a* of the balancer 46 is so inclined that its diameter is gradually increased inward. More specifically, the inner peripheral surface 46*a* of the balancer 46 is in a so-called horn shape whose diameter is increased from its outer portion to its inner portion. Therefore, the drying air introduced from the inlet port portion 58** spreads over the peripheral region of the drum along this horn shape.

Figure 11:
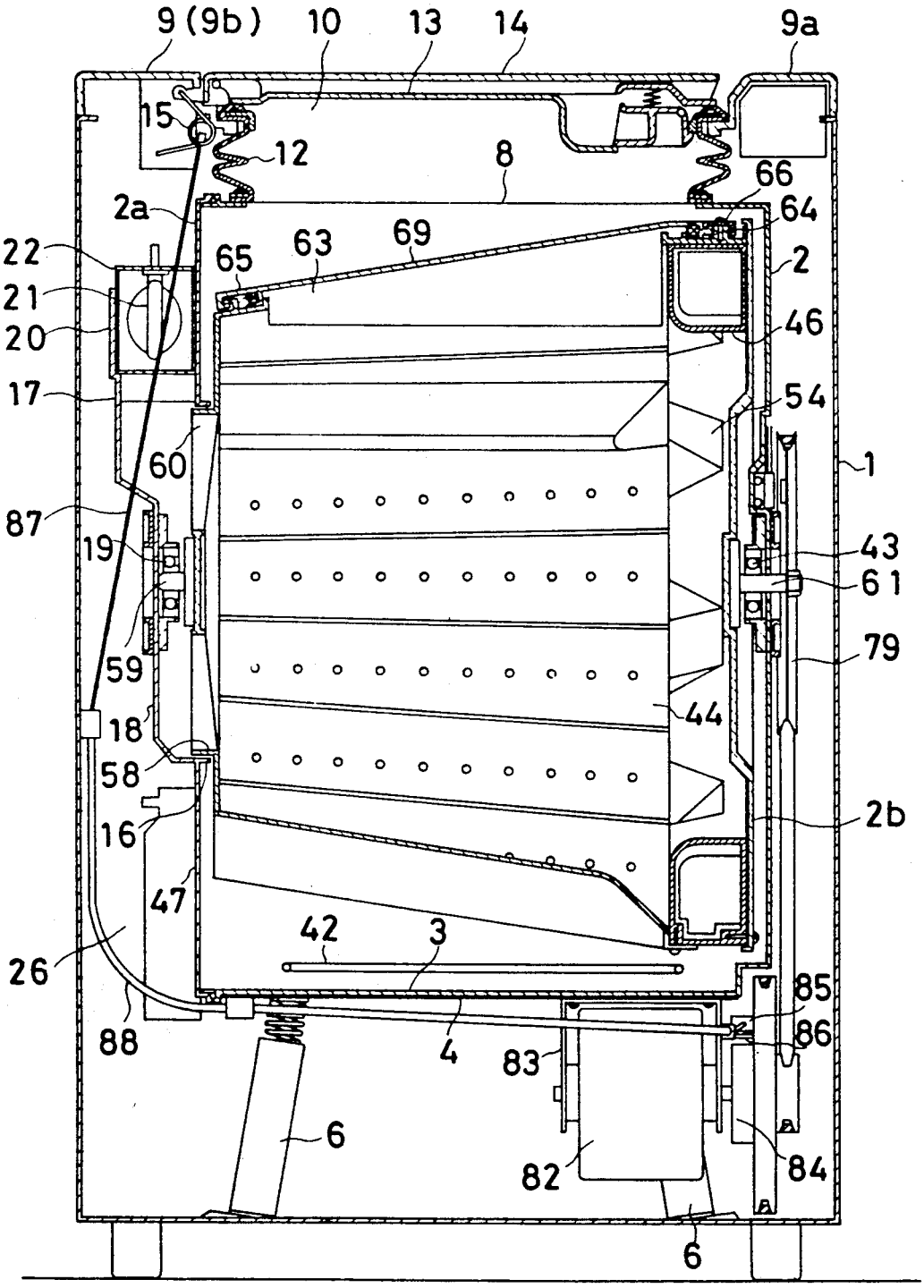

In FIG. 11 embodiment, the inlet port 58 is provided on an end surface on the opposite side of the balancer 46 of the drum 44. More specifically, the drum 44 is sloped downward toward the opposite side of the overflowed water port 23. Accordingly, when the drum 44 is rotated at a time of washing, the water level of the side of the overflowed water port 23 becomes high in the outer tub 2 due to the slope, thereby to make it easy for bubbles to be discharged from the overflowed water port 23.

In addition, in FIG. 11 embodiment, the drying air introduced from the inlet port 58 spreads outward in conformity with the slope of the drum 44 all over the drum 44. Accordingly, the washing machine is superior in a drying performance. Measuring a drying efficiency D through an experimentation in each of FIG. 2 embodiment, FIG. 11 embodiment and the prior art in which a drum is not sloped, 50%, 58% and 50% are obtained, respectively. Therefore, it is to be understood that by forming a slope on an inner peripheral surface of the drum 44 and by forming throughholes 51 on the peripheral surface of the drum 44, the washing machine is superior in the drying efficiency D in comparison with the prior art having no slope. In addition, up to the upper limit of the slope of the drum 44 which is 45°, the larger a slope is, the higher the drying efficiency D is.

Meanwhile, the drying efficiency is calculated by the following equation:

$$\text{drying efficiency } D = (W \cdot K/Q) \times 100[\%]$$

W: amount of water vapolized by drying [kg] (weight of the wash to be dried before drying-weight of the wash to be dried after drying)

K: latent heat of vaporization of water (586) [kcal/kg]

Q: gross power consumption of a washing machine [kWh) × 860 [kcal/kWh]

From the above equation, the washing machine superior in drying performance can efficiently dry the wash with little power consumption, thereby to increase the drying efficiency D.

Figure 12:
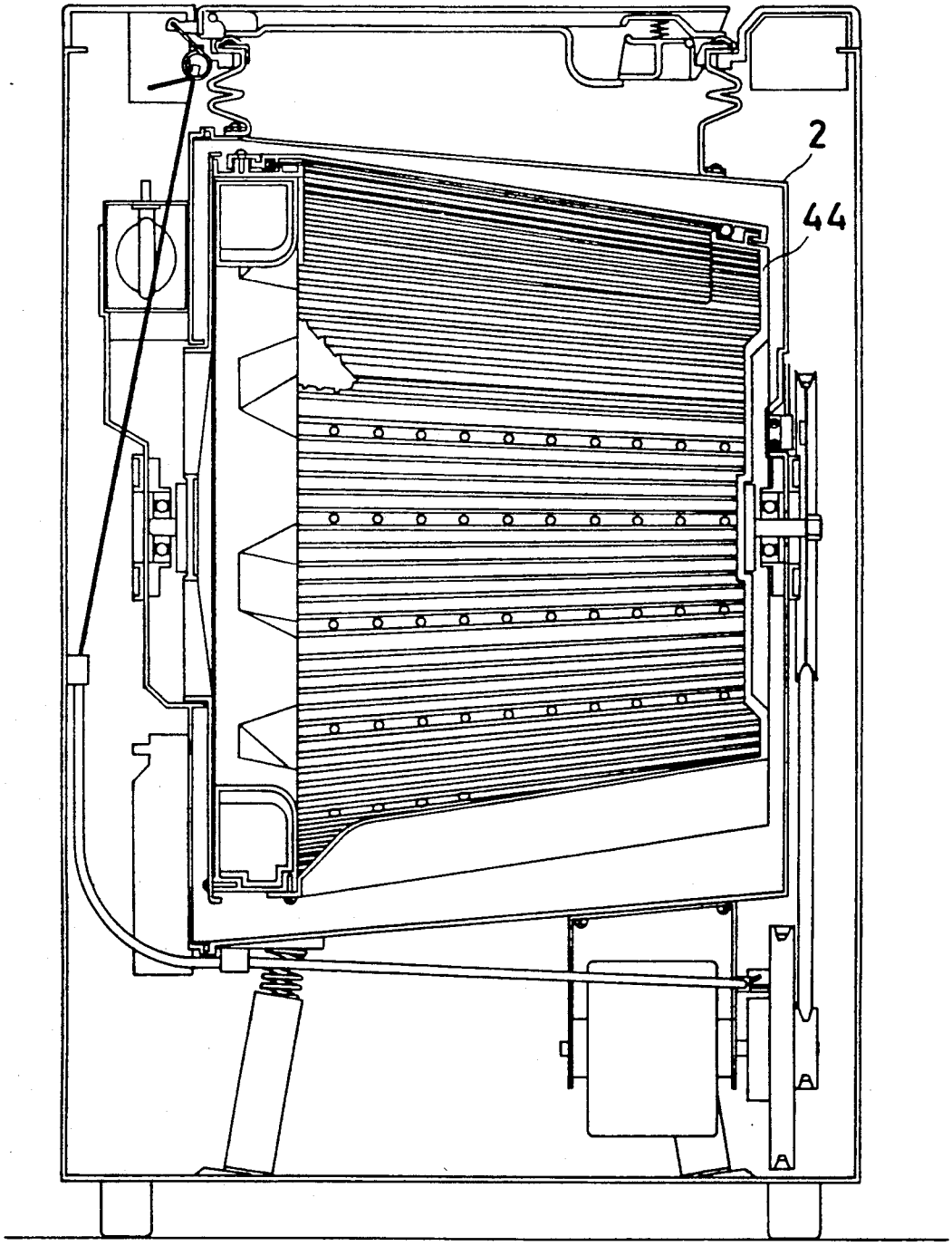

In FIG. 12 embodiment, not only the drum 44 but also the outer tub 2 is molded out of a synthetic resin and, by utilizing a taper or slope for molding a diameter of the outer tub 2 is increased from a side of one end to a side of the other end. More specifically, in FIG. 12 embodiment, the diameter of the outer tub 2 is increased in the same direction of that of the drum 44. Therefore, a gap between the outer tub 2 and the drum 44 becomes minimum, and therefore, no useless space is formed between the outer tub 2 and the drum 44, thereby to make the washing machine compact as a whole. More specifically, if a useless space is formed between the outer tub 2 and the drum 44, when the drum is made large to increase a capacity thereof, the outer tub 2 must be made larger than the drum. However, in accordance with FIG. 12 embodiment, even if the drum 44 is made large, it is not necessary to make the outer tub 2 large so much. Therefore, a compact drum-type washing machine can be obtained.

Figure 13:
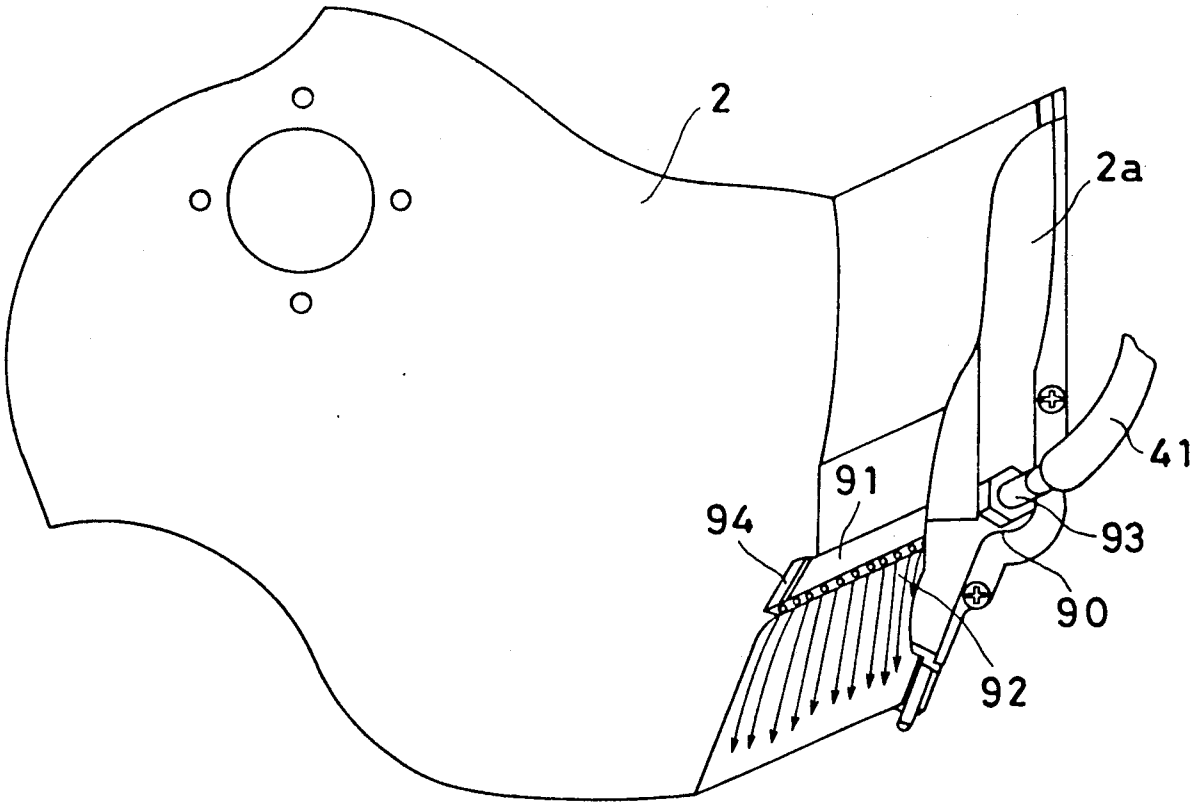
FIGS. 13–15 are illustrative views respectively showing a major portion of an outer tub of FIG. 1 embodiment.
Figure 14:
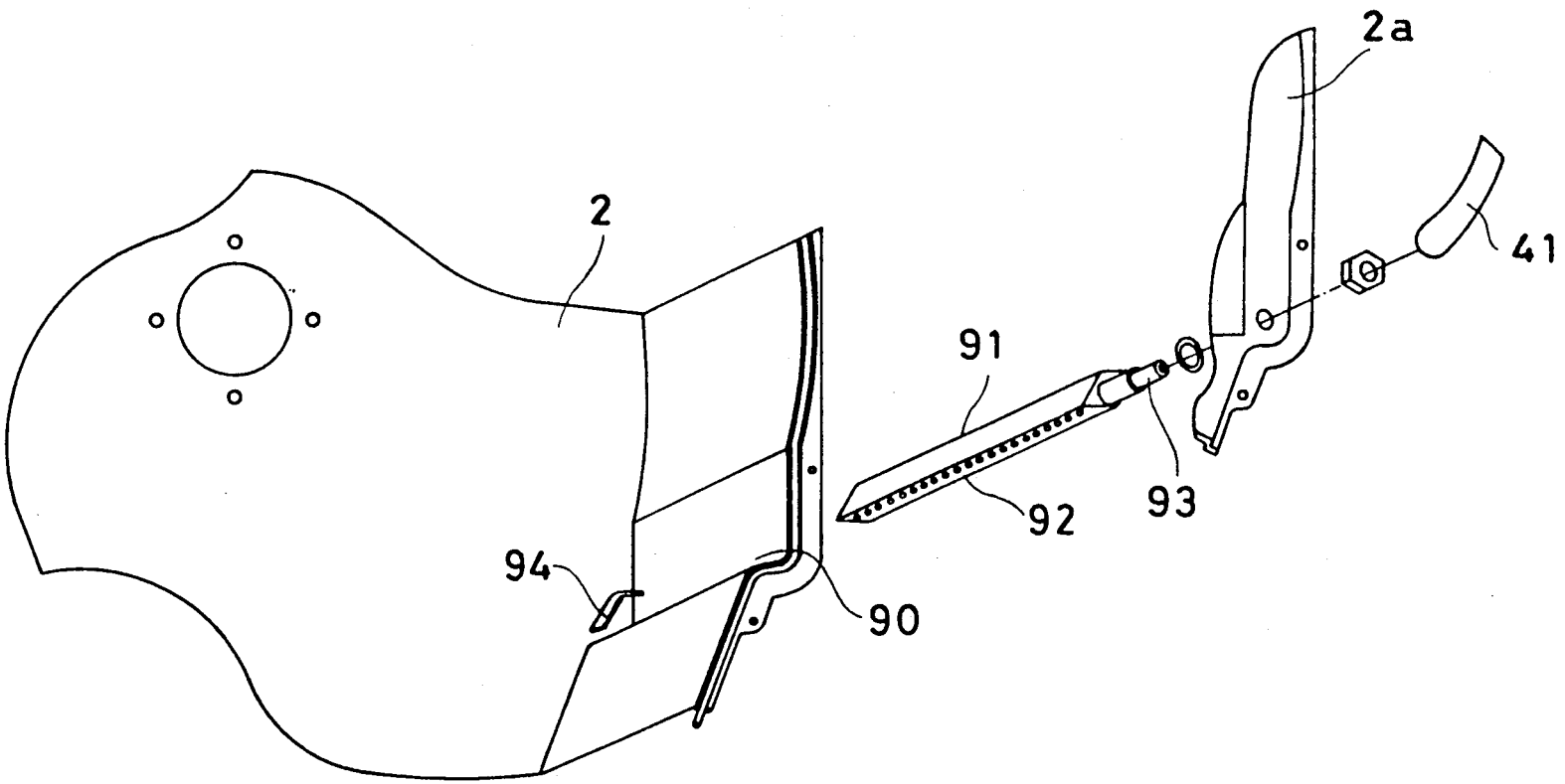
Figure 15:
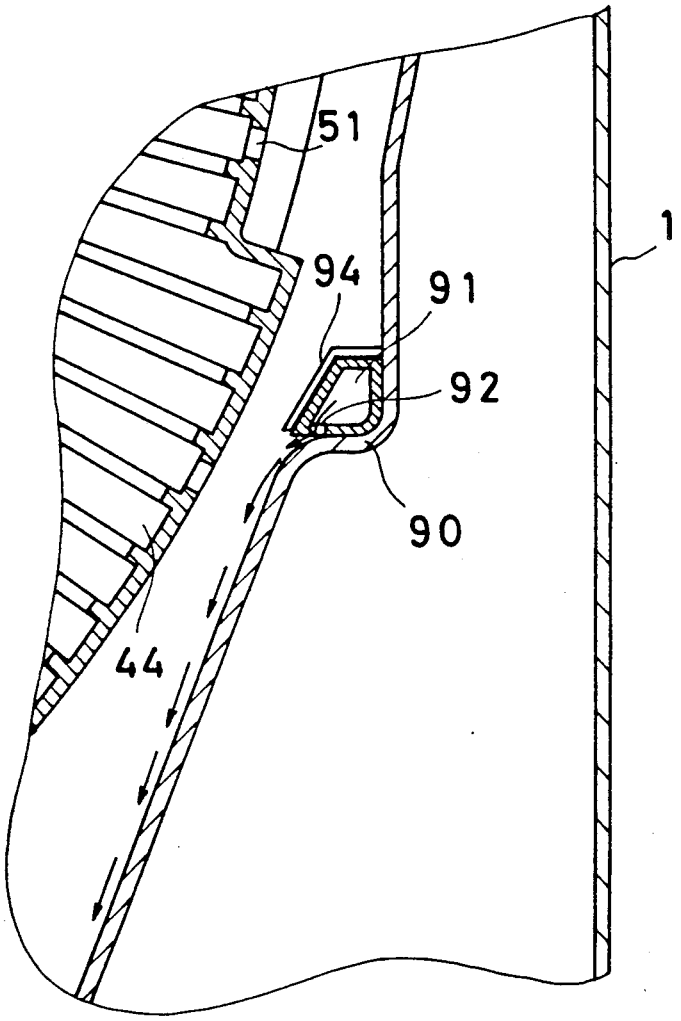

Moreover, in FIGS. 13 to 15, a reference numeral 90 denotes a stepped portion formed in a position at a height which is approximately one-third that of the inner peripheral wall of the outer tub 2. A reference numeral denotes a feed water cylinder disposed and fixed on the stepped portion 90, which is provided with a lot of spray holes 92 along its lower surface so as to face on a lower portion in a disposed state. In addition, one end of the feed water cylinder 91 is closed and the other end 93 is projected from the rear wall **2*a*** of the outer tub 2. A reference numeral 94 denotes a clamp of the feed water cylinder 91. In this case, a water introduced into the feed water cylinder 91 from the second feed water hose 41 is discharged in a shower shape from the spray holes 92, to lead to the drainage port 37 along the inner peripheral surface of the outer tub 2. Therefore, in the drying step or process, the drying air is cooled by the water to be dehumidified.

Figure 16:
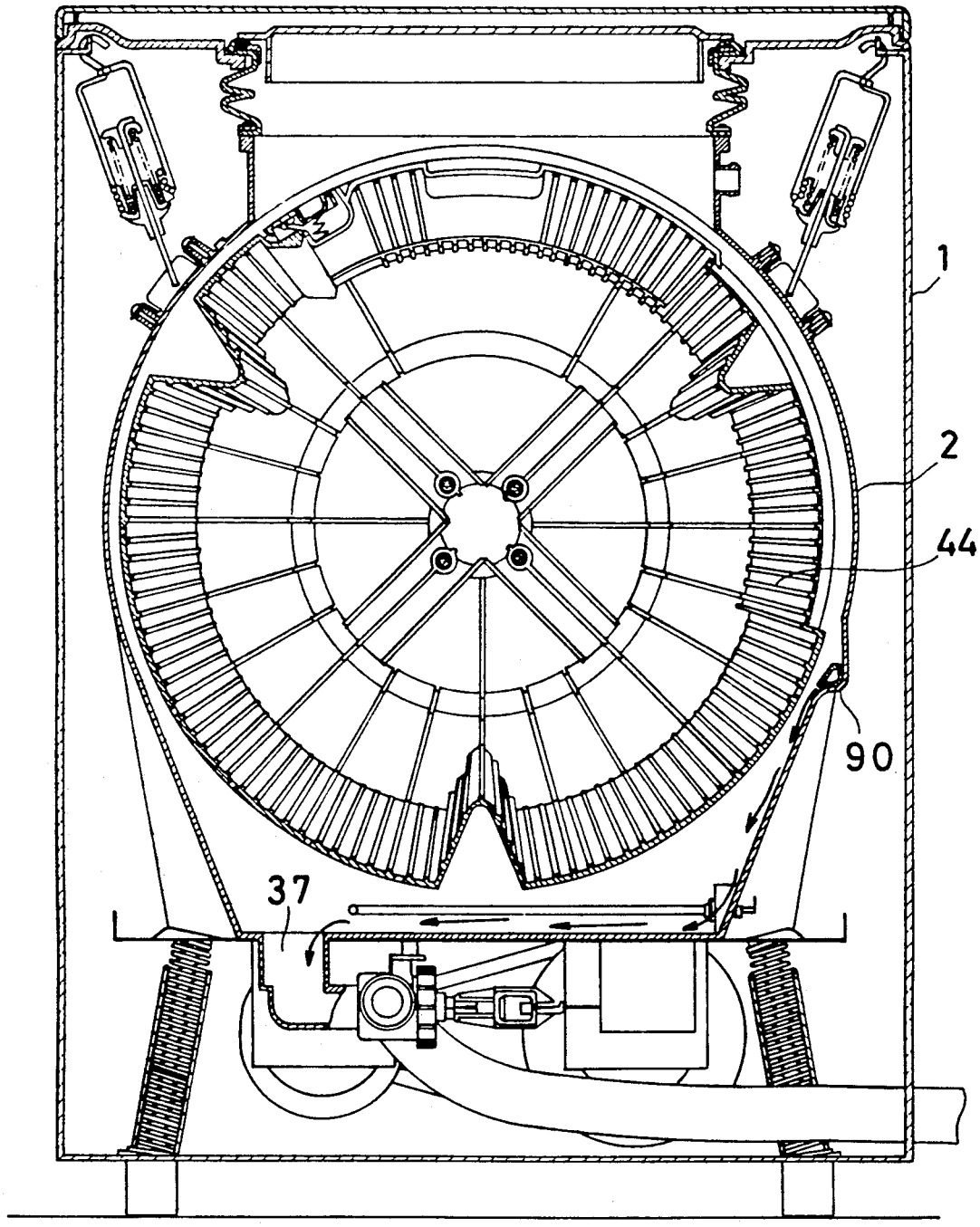
FIG. 16 is an illustrative view showing a waterflow between a feed water cylinder and a drainage port in this case.

As described above, in the drying process, the second feed water valve 38*b* is driven to feed a water to be dropped along the inner peripheral surface of the outer tub 2, and the drying air is cooled by the feed water to be dehumidified. On this occasion, by separating the feed water cylinder 91 from the drainage port 37 as much as possible as shown in FIG. 16, an area under cooling becomes large and a cooling capacity becomes high.

Figure 17:
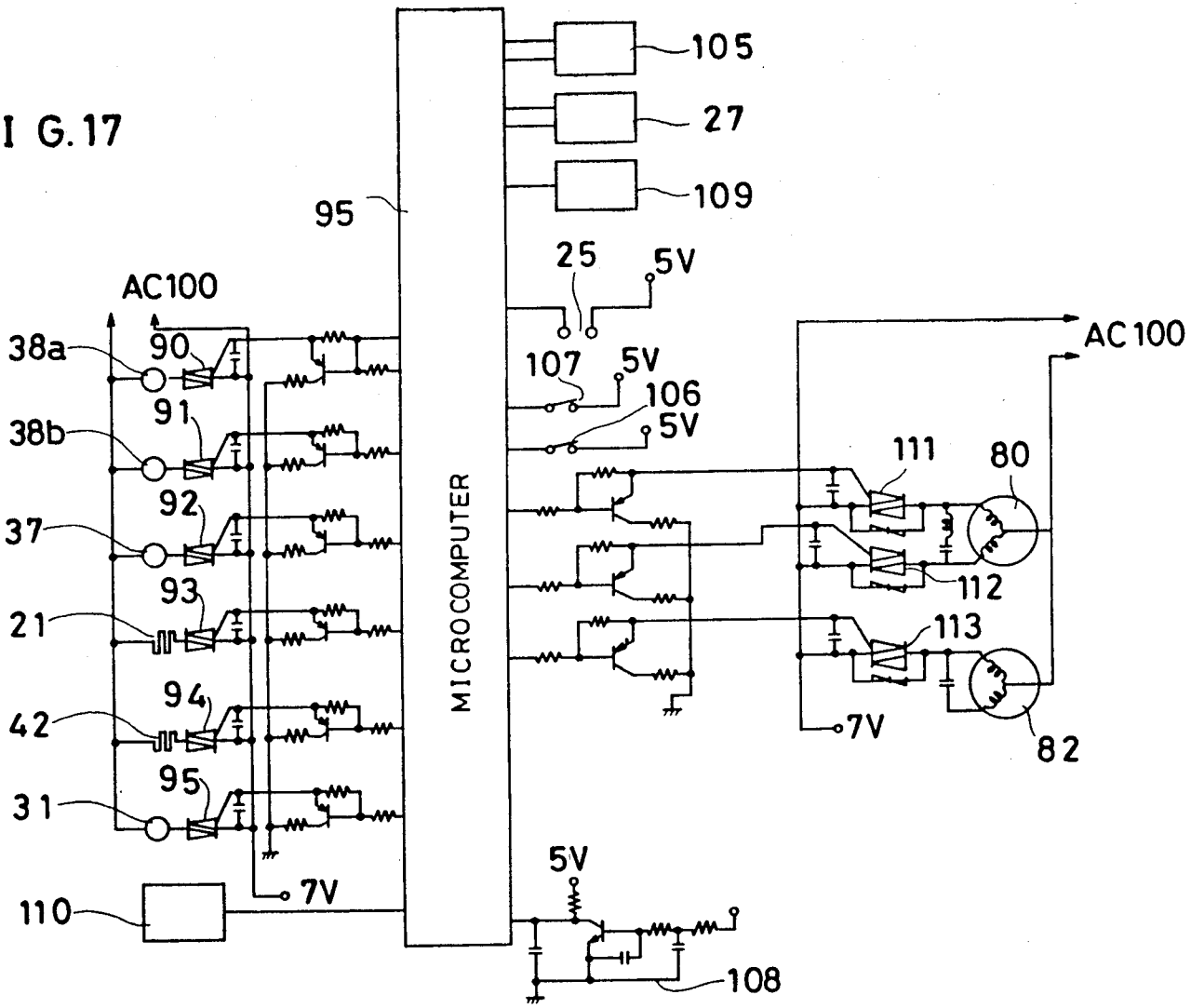
FIG. 17 is a circuit diagram showing an electronic circuitry of the embodiment.
Figure 18:
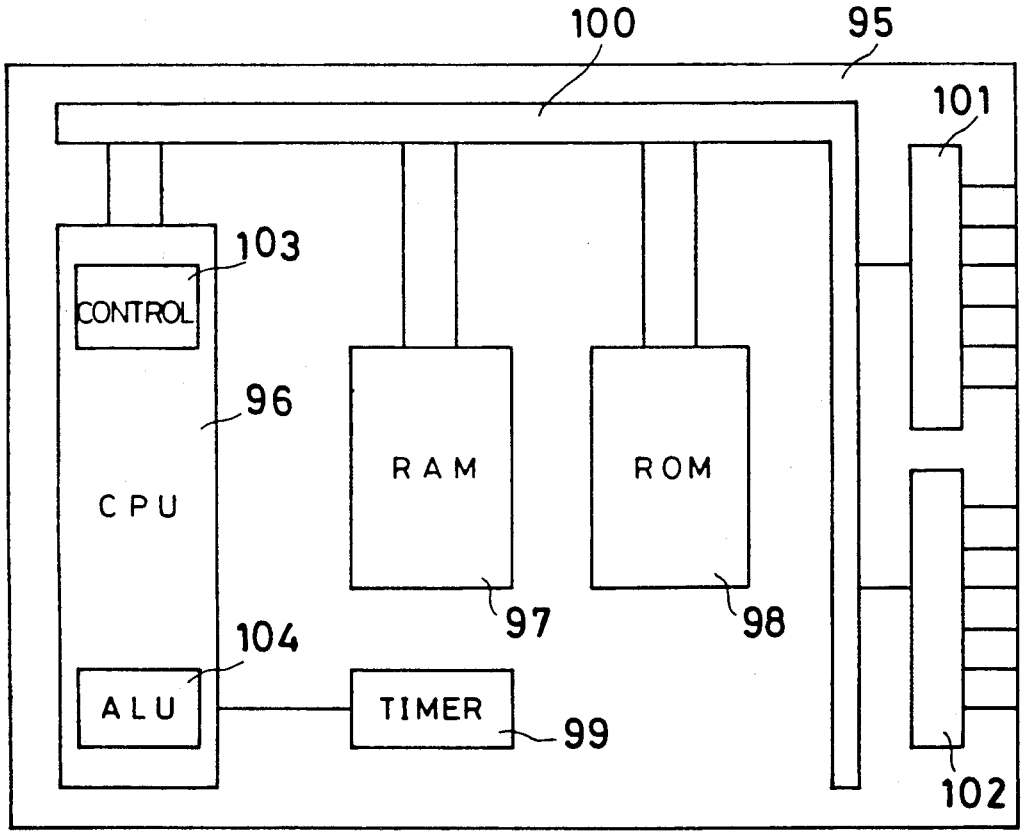
FIG. 18 is a block diagram showing one example of a microcomputer included in FIG. 17 circuit.

In FIG. 17, a reference numeral 95 denotes a microcomputer, for example, an integrated circuit "LC6523" manufactured by Sanyo Electric Co., Ltd. which plays a main role for controlling and, as well known, comprises a CPU (central processing unit) 96, a RAM (random access memory) 97, a ROM (read only memory) 98, a timer 99, a system bus 100 and input and output devices 101 and 102 as shown in FIG. 18.

The CPU 96 comprises a control portion 103 and an ALU 104. The control portion 103 fetches and execute instructions, and the ALU 104 performs arithmetic operations such as binary addition, logical operation, addition and subtraction and comparison on data upright from an input equipment and a memory in response to a control signal from the control portion 103 in executing the instructions. The RAM 97 is used for storing data on the equipment, and the ROM 98 is used for setting a system program and a user program in advance.

Then, signals from an input key circuit 105 including a group of the above described various operation keys 11, the water level sensor 27, a safety switch 106 opened and closed in response to the opening and closing of the upper cover 14, a read switch 107 for detecting a rotation of the drum 44, a reference pulse generating circuit 108, and the electrodes 25 for detecting abnormal foaming are inputted to the microcomputer 95. The microcomputer 95 respectively sends out driving signals to the washing motor 80, the dehydrating motor 82, the first feed water electromagnetic valve 38*a*, the second feed water electromagnetic valve 38*b*, the drainage motor 34, the blast fan 31, the drying heater 21, the heater 42, a buzzer driving circuit 109, an LED driving circuit 110 comprising a group of various light emitting diodes (LEDs) on the basis of the information. In addition, the microcomputer 95 and the respective loads are connected to each other through bi-directional thyristors 111-113, and an ON signal and an OFF signal of each of the bi-directional thyristors 111-113 are sent from the microcomputer 95.

The water level sensor 27 detects a change in a water level in the outer tub 2 as a change in a pressure in the air trap 26, moves a magnetic member in a coil in response to the pressure and as a result, detects the change in the water level as the change in an inductance of the coil, and further detects the change in the inductance as the change in an oscillation frequency to input the same in the microcomputer 95. Therefore, the microcomputer 95 detects continuously and extensively the water level in the outer tub 2 on the basis of the change in the oscillation frequency.

Figure 19:
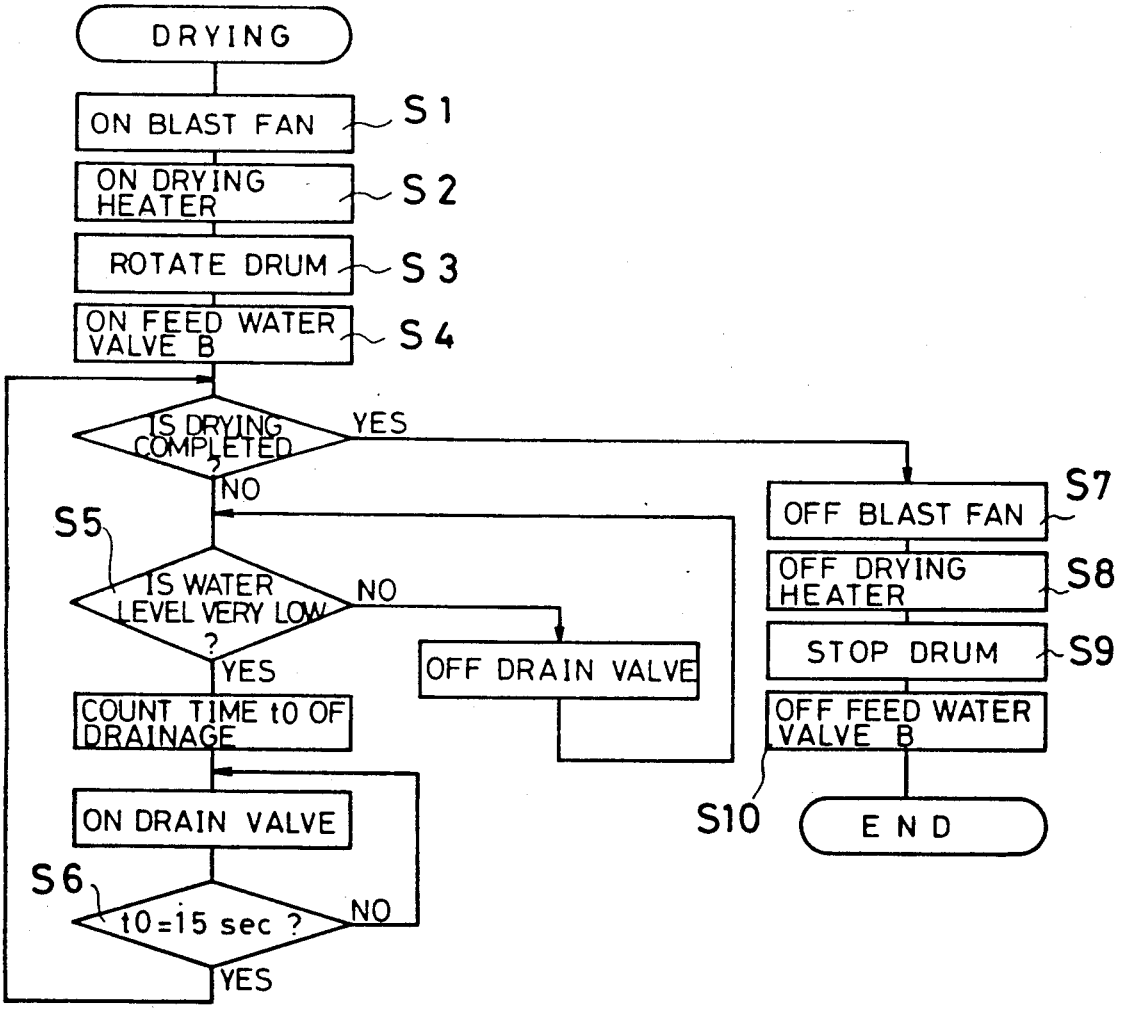
FIGS. 19 and 20 are flowcharts respectively showing different operation in a drying step or process of the embodiment.

In such a construction, an operation of the drying process will be described with the reference to FIG. 19.

In the drying process, the blast fan 31, the drying heater 21, the washing motor 80 and the second feed water valve 38*b* are driven in the steps S1-S4, the heating air is introduced into the drum 44 and at the same time, a dehumidifying water is dropped along the surface of the inner wall of the outer tub 2 from the feed water cylinder 91. During this time period, the drain valve 36 is closed. Accordingly, the dehumidifying water is gradually accumulated in the bottom portion of the outer tub 2 to suspend in the dehumidifying water waste thread in the bottom portion of the outer tub 2. If the water level sensor 27 senses a water level substantially lower than that the lower most portion of the drum 44 in the step S5, it is energized to the drainage motor 34 to open the drain valve 36 for fifteen seconds in the step S6. Consequently, the dehumidifying water accumulated in the bottom portion of the outer tub 2, along with the waste thread, is discharged to the exterior of the washing machine. Thereinafter, such a series operations are repeated to the end of the process, and when the drying process is completed, in the steps S7-S10, all of the blast fan 31, the drying heater 21, the washing motor 80 and the second feed water valve 38*b* are turned-off. In addition, the drying process may be timing control or one for determine the degree of process of drying by, for example, a humidity sensor.

As described in the forgoing, an area of a portion where the humidifying water is accommodated becomes an area under cooling in addition to an area under water feeding from the feed water cylinder 91 to the drainage port 37 by carrying out control such that the humidifying water is accommodated once in the bottom portion of the outer tub 2, to make it is possible to obtain a high cooling capacity.

In addition, although in FIGS. 13-16, the drainage port 37 is made the farthest apart from the feed water cylinder 91, the drainage port 37 may be provided anywhere in such a control method, in which case the area under cooling is not changed. Accordingly, a position of the drainage port 37 is not limited, to increase a degree of freedom in design.

Figure 20:
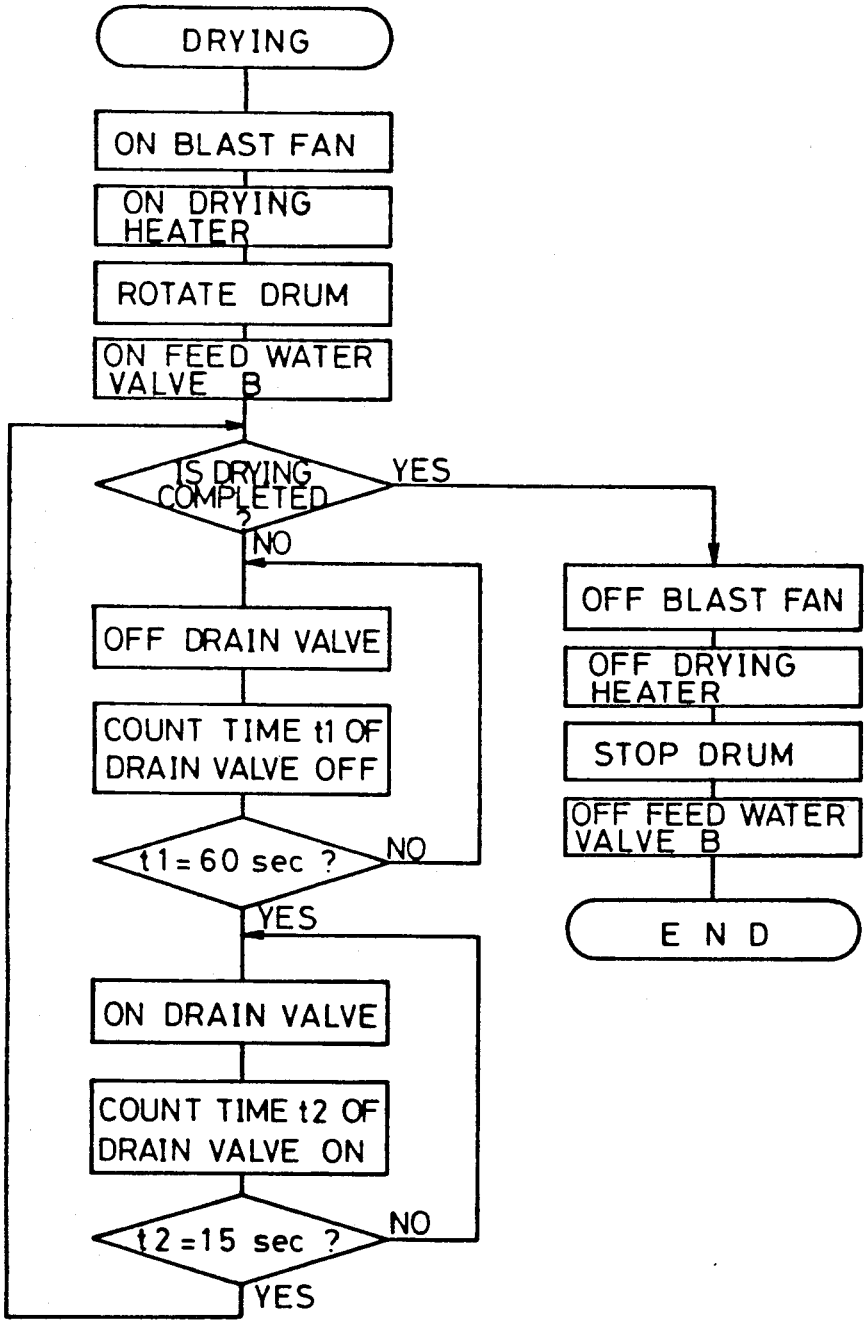

FIG. 20 is a flowchart showing another embodiment in accordance with the present invention, wherein in the drying step or process, the drain valve 36 is intermittently opened and closed for a period of sixty seconds in an off state (closed state) followed by fifteen seconds in an on state (opened state). Such periods should be suitably changed in accordance with the capacity of the outer tub 2 and the water feeding capacity.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A drum-type washing machine, comprising:

a frame;

an outer tub supported in said frame;

a horizontal shaft-type drum having opposed ends and being rotatably supported in said outer tub, said drum having a diameter which is gradually increased from one said end to the other said end; and an annular balancer fitted to said other end of said drum for preventing vibration of said drum in a drying operation of said machine, said balancer having a generally symmetrical configuration over its circumferential length.

2. A drum-type washing machine as in claim 1, wherein said annular balancer is a fluid balancer including a continuously hollow annular member and a fluid sealed therein.

3. A drum-type washing machine as in claim 2, wherein said drum includes a body portion molded out of a synthetic resin, at least said other end of said body portion being open; and a plate member for sealing said opening at said other end of said body portion.

4. A drum-type washing machine as in claim 1, wherein said drum includes a body portion molded out of a synthetic resin, at least said other end of said body portion being open; and a plate member for sealing said opening at said other end of said body portion.

5. A drum-type washing machine as in claim 4, wherein the diameter of said body portion is increased gradually from said one end to said opening at said other end the increase in diameter corresponding to the slope of a mold used in molding said body portion from plastic.

6. A drum-type washing machine in accordance with claim 5, further comprising ribs formed on an inner peripheral surface of said drum.

7. A drum-type washing machine as in claim 1, further comprising ribs formed on an inner peripheral surface of said drum and extending from said one end to said other end.

8. A drum-type washing machine in accordance with claim 7, further comprising a clothes entering port formed on a peripheral surface of said drum; and a cover for opening and closing said clothes entering port.

9. A drum-type washing machine in accordance with claim 8, further comprising ribs formed on an inner surface of said cover.

10. A drum-type washing machine in accordance with claim 8, further comprising a storing portion formed on an upper surface of said cover for storing a washing processing agent.

11. A drum-type washing machine as in claim 1, wherein an inner peripheral surface of said balancer is positioned inside the drum, and further comprising a concave portion formed on said inner surface of said annular balancer.

12. A drum-type washing machine as in claim 1, wherein an inner peripheral surface of said balancer is positioned inside said drum, and further comprising a drying air introducing portion formed on the other end of said drum; and an inclined surface formed on said inner peripheral surface of said balancer to be expanded from its outer portion to its inner portion so as in operation, to spread drying air over an inner peripheral region of said drum.

13. A drum-type washing machine in accordance with claim 1, further comprising a drying air introducing portion formed on one of said ends of said drum.

14. A drum-type washing machine in accordance with claim 1, further comprising a water overflow port formed on said outer tub, said water overflow port being at a position opposite to said other end of said drum.

15. A drum-type washing machine in accordance with claim 1, further comprising a water overflow port formed on said outer tub, said water overflow port being arranged at a position opposite to said one end of said drum.

16. A drum-type washing machine in accordance with claim 1, wherein the diameter of said outer tub increases in the same direction as that of said drum.

17. A drum-type washing machine in accordance with claim 1, further comprising feed water means for flowing water along an inner wall surface of said outer tub in a drying process; a drainage port for draining water from said outer tub; and valve means for opening and closing said drainage port.

18. A drum-type washing machine in accordance with claim 17, further comprising valve opening and closing means for intermittently opening and closing said valve means in said drying process.

* * * * *